US005400053A

United States Patent [19]

Johary et al.

[11] Patent Number: 5,400,053

[45] Date of Patent: Mar. 21, 1995

[54] METHOD AND APPARATUS FOR IMPROVED COLOR TO MONOCHROME CONVERSION

[75] Inventors: Arun Johary, San Jose; Morris E. Jones, Saratoga, both of Calif.

[73] Assignee: Chips and Technologies, Inc., San Jose, Calif.

[21] Appl. No.: 716,149

[22] Filed: Jun. 17, 1991

[51] Int. Cl.[6] ..... G09G 3/00

[52] U.S. Cl. ..... 345/147; 345/114

[58] Field of Search ..... 340/793, 701, 703, 784 BI; 358/76, 78, 80, 166, 30; 345/147, 150, 153, 185, 186, 199, 114

[56] References Cited

U.S. PATENT DOCUMENTS

| | | | |
|---|---|---|---|
| 4,688,031 | 8/1987 | Haggerty | 340/703 |
| 4,779,083 | 10/1988 | Ishii et al. | 340/784 |
| 4,992,862 | 2/1991 | Gaber | 358/78 |
| 5,016,097 | 5/1991 | Shimano | 358/79 |

FOREIGN PATENT DOCUMENTS 2-135392 5/1990 Japan .

*Primary Examiner*—Ulysses Weldon
*Assistant Examiner*—Doon Chow
*Attorney, Agent, or Firm*—Townsend and Townsend Khourie and Crew

[57] ABSTRACT

A method and apparatus for improving the quality of a color-to-gray scale conversion is disclosed. A table is generated providing a visually correct conversion of all possible background/foreground colors. This table is then stored. In operation, after the attribute byte describing the foreground and background colors is retrieved from memory, it is used to access the stored conversion table, wherein its gray scale equivalent is stored. The stored equivalent is then used to generate the gray scale LCD display. In other embodiments, multiple copies of the table are stored, making multi-frame operations very efficient in operation.

6 Claims, 4 Drawing Sheets

METHOD AND APPARATUS FOR IMPROVED COLOR TO MONOCHROME CONVERSION

BACKGROUND OF THE INVENTION

The present invention relates to computers. In particular it relates to converting color signals so that they can be displayed on a monochrome liquid crystal display ("LCD") or other monochrome displays.

The problem of converting a color signal used to drive a color-capable cathode ray tube ("CRT") to a video signal capable of driving a monochrome display is known. Several methods have been devised for solving the problem, but no solution has been completely successful. Although the discussion of this problem and its solution will be limited to those systems which use the Color Graphics Adapter ("CGA") standard, nothing herein should be taken to limit the present invention to a system using the CGA standard only. The Enhanced Graphics Adapter ("EGA"), the Video Graphics Array ("VGA") and others could be readily accommodated by the present invention.

A known process by which color displays are generated using the CGA standard is illustrated in FIG. 1. When the system is operating in character mode, there are color control bits associated with each byte of character data. For the purposes of this description, the byte of character data comprises the character code ("CCode") and the color control bits are called the attribute byte. As shown in FIG. 1., after the central processing unit ("CPU") generates a display memory address at step 11, the CCode and attribute byte are retrieved from memory at step 13. The CCode is used to generate an address for accessing the font memory at step 15 and that address is used to retrieve the font pattern from memory at step 17. The font pattern is loaded into a shift register at step 19, where an On/Off serial bit stream is generated. Both the output generated by the shift register at step 19 and the attribute byte are used to select the desired background and foreground colors at step 21. The result of this selection is transmitted to a CRT for display. FIG. 1. also shows the average number of clock cycles required for each step beneath each step.

When a Liquid Crystal Display ("LCD?) or another, similar type of display is used, it is only capable of displaying a monochrome image. FIG. 2 shows how the CGA character display mode shown in FIG. 1 has been modified to accommodate this limitation. Steps 11, 13, 15, 17, 19 and 21 are identical with the same steps in FIG. 1. At step 23, the 4-bit color information is converted to a gray scale value using any one of many known gray scale conversion methods. The output from conversion step 23 is reassembled into 4 bits of pixel information at step 25 and then transmitted, 4 pixels at a time, to an LCD. Once again, the average number of clock cycles required for each of these steps is shown below each of the steps.

In order to deal with certain visual deficiencies which result from known gray scale conversion methods, a method and apparatus for improving the process was described in commonly-owned U.S. Pat. No. 4,977,398 ("'398"), entitled "Color to Monochrome Conversion" issued to Pleva et al., the contents of which application are hereby incorporated by reference for all purposes. The method used in the '398 patent modifies the attribute byte fetched in step 13 of FIGS. 1 and 2. As shown in FIG. 3, after the attribute byte has been fetched at step 13, it is transmitted to special hardware 28 which performs the following steps: at steps 27 and 29, the foreground and background colors are converted from their color codes to their gray scale equivalents. This conversion relies on an assumption that the way the colors are encoded is a logical way to convert them to a gray scale pattern. At step 31, the arithmetic difference between the foreground and background gray scales is compared. If the two calculated gray scales are very close to one another, and would not contrast sufficiently, the two gray scales are "pulled apart" to make the difference between them greater, making it easier to distinguish the foreground and background. The "pulling apart" is done by "increasing" the gray scale value for the "bigger" gray scale value and/or "decreasing" the gray scale value for the "smaller" gray scale. This occurs at steps 33 and 35. The remainder of the conversion process is identical to that shown in FIG. 2, and, as in FIG. 2, the approximate number of clock cycles required for each step is noted below each step.

Although the method taught in the '398 patent improves the gray scale presentation, it does have several deficiencies. In general, the direct conversion of the color code to gray scale used is not consistent with a "correct" conversion. In a "correct" conversion the gray scale conversion has the equivalent amount of energy or "brightness" to each of the colors in the color display. For the gray scale display to look visually correct, the translation of colors to gray scales has to be different.

Additionally, the algorithm used in the '398 patent is too rigid. As it is a mathematical method, the same translation/separation is applied to two gray scales anytime they have the same difference, regardless of the actual gray scales being used. If the situation is viewed subjectively, from a visual, "artistic" point of view, some , colors (yellow/white) are barely distinguishable even on a color CRT, whereas some combinations (blue/green or green/bright red) are quite distinguishable, in spite of their having the same gray scale difference. To accommodate these situations, the attribute bytes should be modified based on the specific foreground and background colors. This process, if done by random logic, would be very complex and still quite rigid.

The need exists for a color to gray scale conversion method and apparatus that can provide visually correct gray scale conversions, with the appropriate light energy levels for the background and foreground areas, and yet remain flexible for possible user modifications.

SUMMARY OF THE PREFERRED EMBODIMENTS

In a first preferred embodiment, the present invention achieves its color to gray scale conversion by first generating a table wherein each entry in the table is the gray scale conversion for a given foreground and background color pattern. The conversion is chosen so as to be visually correct. As the attribute byte contains 8 bits of color information, four for the foreground color and four for the background, the gray scale conversion table also has 8-bit entries. As there are 256 entries comprising all possible color combinations, assuming the display is capable of displaying 16 colors, the table is 256 bytes long and 8-bits wide. Although the present invention discusses a table used to convert signals having 16 different colors, expansion of the method and apparatus described herein can be readily achieved.

After the table is generated and stored in memory, the attribute byte is used to access the conversion table. The conversion code from the table is used to create the appropriate visually correct gray scale conversion and display.

Additional embodiments and details of the present invention will be described in the detailed specification below, wherein reference is made to the following figures.

DETAILED DESCRIPTION OF THE SPECIFIC EMBODIMENTS

Figure 1:
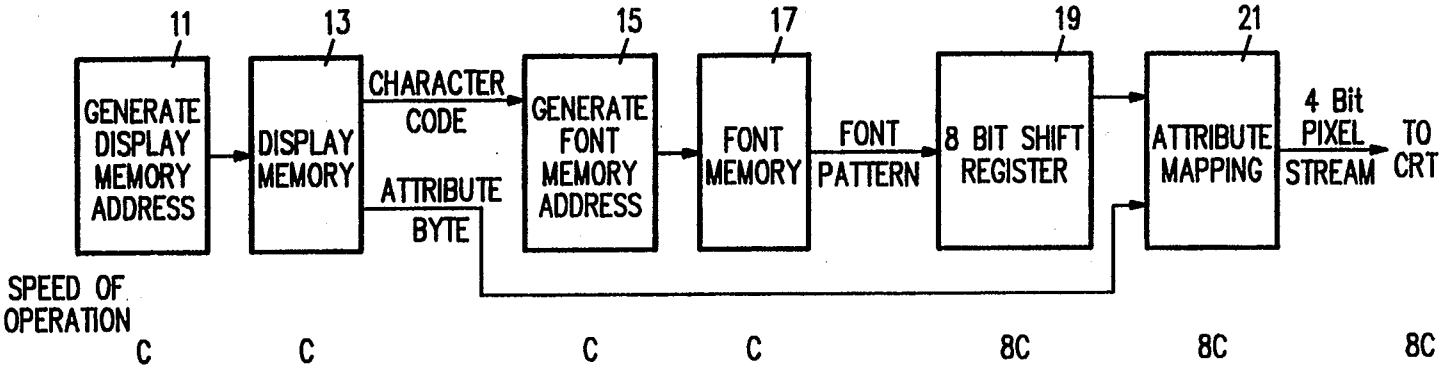
PRIOR ART FIG. 1
FIG. 1 is a flow chart showing CGA text mode pixel generation.
Figure 2:
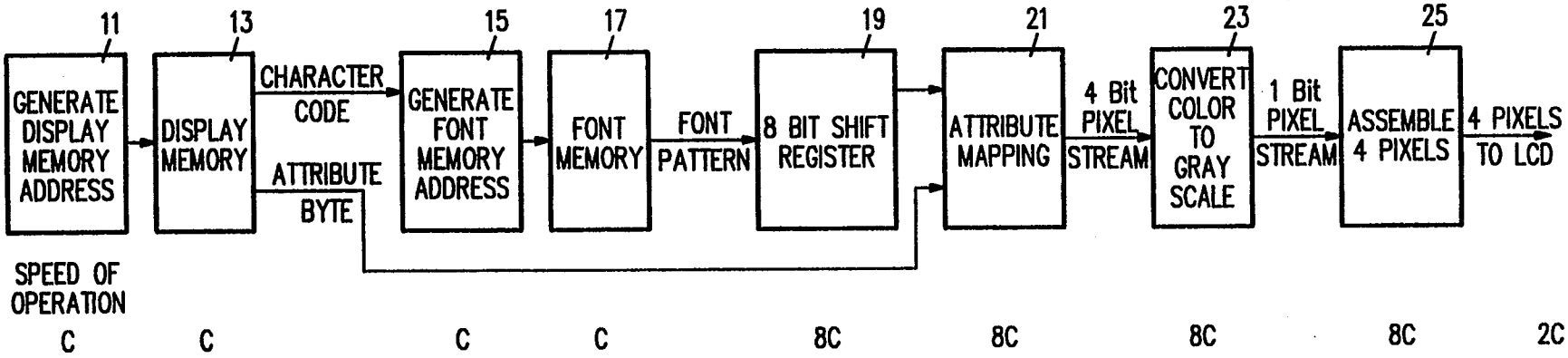
PRIOR ART FIG. 2
FIG. 2 is a flow chart showing CGA text mode pixel generation as modified for an LCD display.
Figure 3:
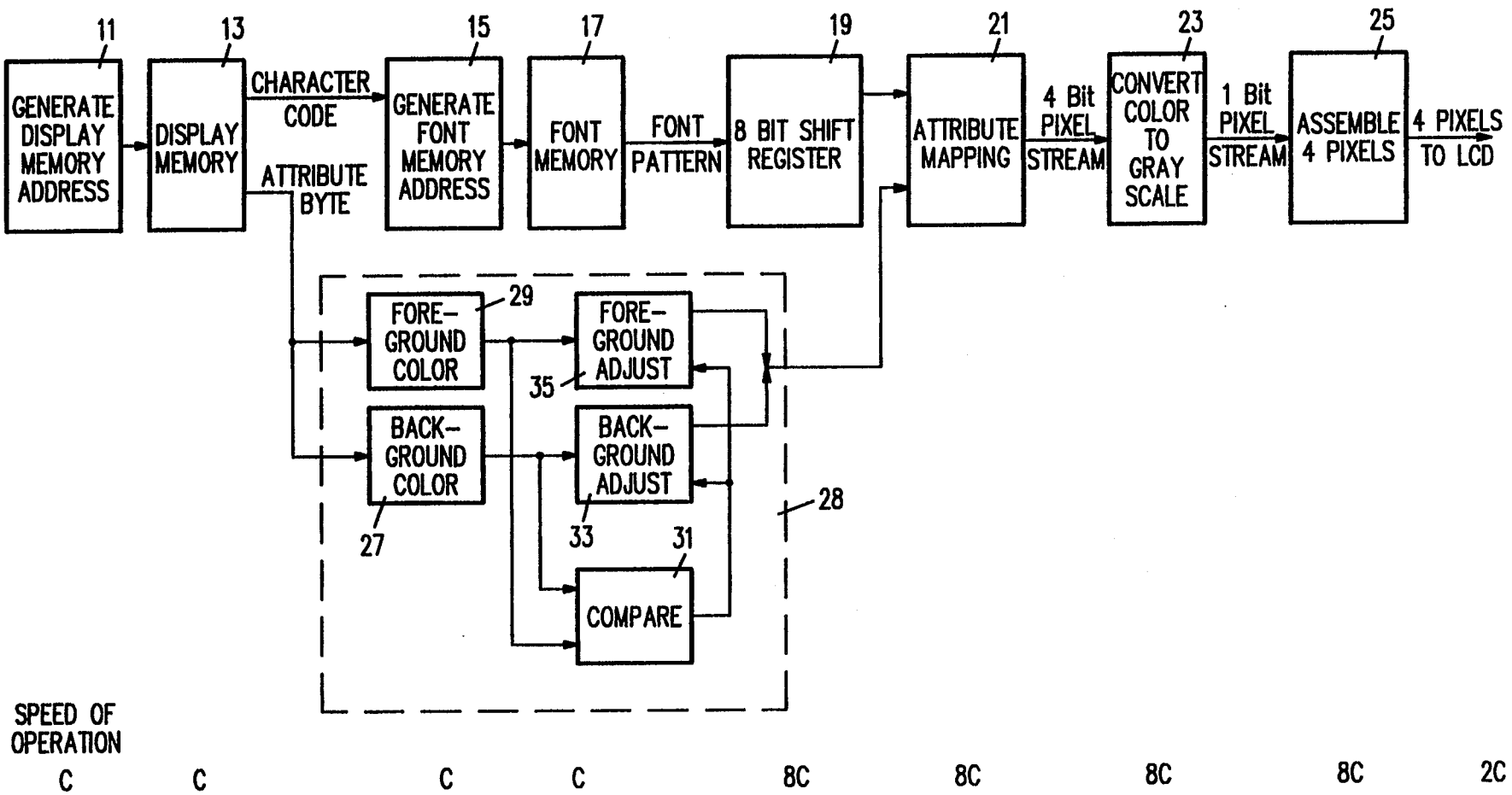
PRIOR ART FIG. 3
FIG. 3 is a flow chart showing CGA text mode pixel generation for an LCD display with a first known process for improving the color-to-gray scale conversion process.
Figure 4:
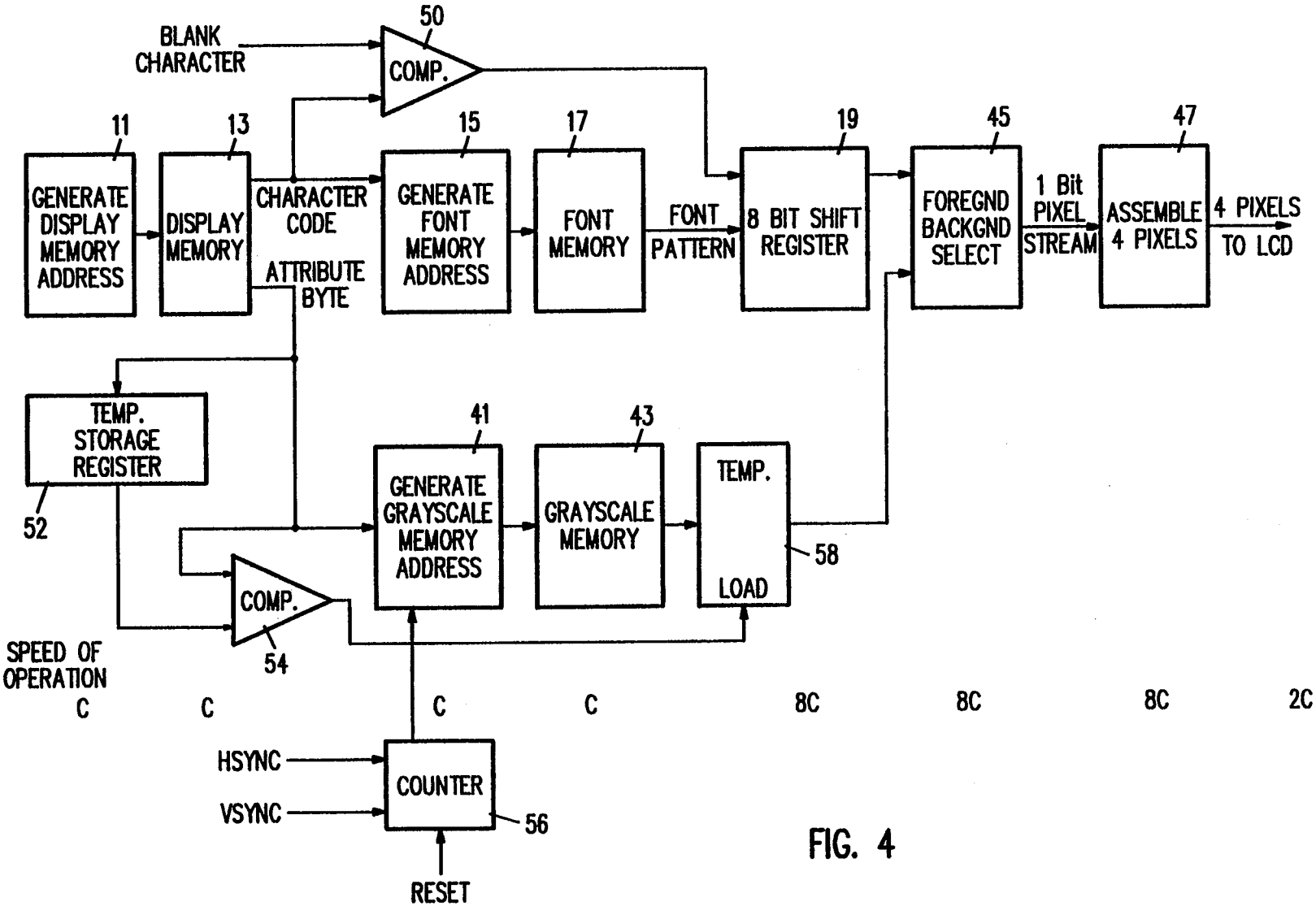
FIG. 4 shows a first embodiment of the present invention.

A flow chart illustrating the method which comprises the first embodiment of the present invention is shown in FIG. 4. As in FIGS. 1, 2 and 3, step 11 comprises the generation of a display memory address which is used, at step 13, to access a display memory. As in the known art, 2 bytes of data are stored for each character. The first byte comprises an 8-bit CCode. As in FIGS. 1, 2, and 3, the CCode is used to generate an address for accessing the font memory at step 15 and that address is used to retrieve the font pattern from memory at step 17. The font pattern is loaded into a shift register at step 19. The second byte comprises 4-bits indicating the desired background color and 4-bits indicating the desired foreground color. Together these 8 bits are called the attribute byte. Using 4 bits, 16 colors can be specified for either the foreground or background color, with a total of 256 different combinations of background and foreground colors.

For each attribute byte, an appropriate gray scale conversion byte is calculated. The calculation is based on a visually correct conversion with the appropriate amount of energy (brightness) being given to each color. The specific resultant conversion factors are based on an artistic sensibility rather than a mathematically exact, linear conversion. The table which comprises the 256 bytes of conversion bytes is known herein as the gray scale table. To calculate these codes internally, using hard wired logic circuits or other, similar circuits, would be very hardware intensive. Instead, after the conversion codes are generated once by the programmer, they are loaded and stored in memory. Thus the attribute byte is used to generate an address for accessing the grayscale memory (in which the gray scale table is stored) at step 41 and that address is used to retrieve the gray scale byte at step 43. The gray scale byte is combined with the font pattern bits at step 45 and the pixels are assembled and sent to the LCD at step 47.

Although the use of memory to store the gray scale table requires additional space in the memory and at least one extra clock cycle to access the memory, both these requirements are easily satisfied in most systems using standard current graphic adapters such as the CGA and EGA.

At the very minimum, the CCodes and their related attributes require 16k bytes of memory. A need for 16k of memory can be satisfied by either two 8k byte memories or one 32k byte memory. Memories are not available in 16k byte units. For practical reasons such as part count and reliability, it is generally the practice to use a single 32k byte memory. Given the use of a 32k byte memory, there is a minimum of 8k bytes available to store a 256 byte gray scale table.

In a similar fashion, the present invention takes advantage of the fact that graphics applications are written for CRT monitors. To drive a CRT monitor in a character mode with a CGA, four memory cycles are needed: one to read the CCode, one to read the attribute byte, one to obtain the character font and one to allow the CPU to access the memory, if necessary. In the present invention, a fifth memory access to obtain the gray scale code is needed.

This fifth memory access can be achieved in one of several ways. For instance, the period of time needed for each access can be reduced, thereby increasing the number of accesses per unit of time. In the present invention, which uses an LCD, not a CRT, the beam retrace time is used for this fifth access. In the display cycle for a CRT, a certain amount of time is needed to deflect the electron beam from one side of the CRT to the other. In the present invention, instead of trying to reduce the individual memory access time to permit a fifth access to memory in the same time interval previously used for four accesses, the period of time normally set aside for the CRT's electron beam retrace is used for the fifth access.

In any given display, it has also been observed that the attribute byte frequently does not change as one moves from pixel to pixel. As each attribute byte for each row of text is read from memory step 13 and used to access the gray scale table step 41, it is also stored in a temporary storage register 52. As each succeeding attribute byte is read, it is compared with the attribute byte stored in the temporary register at step 54. The new value is only used to access the gray scale table 41 if it differs from the value in the register 52. As the attribute byte changes relatively infrequently, this comparison operation eliminates many time-consuming and power-consuming accesses to memory.

Memory reads are also reduced by detecting blank characters and treating them as a special case. Instead of reading the memory for a font steps 15 and 17 for every character, if the character is a blank character, there is no font and no need to read the memory for it. Referring to FIG. 4, at step 50, if a blank character is detected, the font memory access (steps 15 and 17 )is by passed. Thus, of the five memory accesses that may be necessary to display a given character, frequently only two accesses are actually performed. The CCode and attribute code always need two memory accesses. However, as the character is often a blank, the font access can be eliminated. In addition, if the new attribute code is the same as the previous character, no gray scale access is necessary. Additionally, the CPU access is always optional.

LCDs display shades of gray by turning pixels on and off over a given time interval. The time interval is generally divided into several frames. For example, if 16 gray levels are to be provided, as in a preferred embodiment of the present invention, over 16 successive frames (a frame comprising the entire LCD display at one predefined time interval), individual pixels will be on or off in a varying number of the frames. For example, if one pixel is white, it is off during all 16 frames. If the pixel is black, it is on during all 16 frames. Shades of gray between black and white are created by turning the pixels on and off for varying numbers of the frames.

Given this known method for generating a gray scale image, a second embodiment of the present invention incorporates multiple gray scale tables. Each separate table defines pixels which should be on or off in that frame to provide the desired gray color. Further, as in each frame a pixel can only be on or off, only 2 bits are needed to describe the foreground and background pixels in each frame for a particular gray level. Thus, given 16 frames, 256 possible combinations of foreground/background colors, and 2 bits for every combination of colors, 8192 bits are needed to implement the 16 gray scale lookup tables. In previous gray scale implementations, a counter 56 was used to determine the frame number and the output from the counter in combination with the desired gray scale was used to access a truth table to provide the proper on/off pixel output for each frame. As this method was implemented in hardware (sometimes by programmable logic arrays), it was difficult to alter the display appearance. The present invention, as it is implemented using memory lookups and a plurality of lookup tables, can be easily altered if so desired.

The use of a plurality of gray scale tables as described herein also greatly simplifies the process whereby color information is displayed as a gray scale image on an LCD. Instead of the color attribute being converted to a gray scale using a first table, and the gray scale being converted to a Frame Rate Control ("FRC") pattern using a second table, the two tables have been merged into a single table which is used for a single lookup in the present invention, which changes the color attribute into a proper FRC pattern directly.

For an FRC technique to work properly, when adjacent pixels on the LCD have the same gray scale, they should be separated in phase. When adjacent pixels having the same gray scale are allowed to be in phase, perceptible amounts of "flickering" can be seen over large portions of the screen. However, if phase separation is introduced improperly, the LCD may appear to be in "motion" with the pixels appearing to shimmer and move about in a certain direction. Several actions can be taken to reduce this apparent motion. Every pixel in the display should have the same duty cycle (over time). For every frame, the same fraction of pixels in a screen region should be ON to achieve the gray scale specified for that region (provided that the entire region is one color). The fraction of pixels over a given region that are ON for each frame should be uniformly distributed. Finally, to prevent "patterning", which occurs if the same pixels remain ON and OFF from frame to frame, the actual pixels which are turned on should be randomly varied from frame to frame. These techniques are known.

To implement these requirements in a hard-wired logic circuit would be very difficult. As a certain amount of randomness is needed, any regular hardware structure used to generate the pixel sequences will probably be ineffective. To correct this problem, the present invention predefines the pixel display sequences. The predefined sequences are then encoded in the tables.

Figure 5:
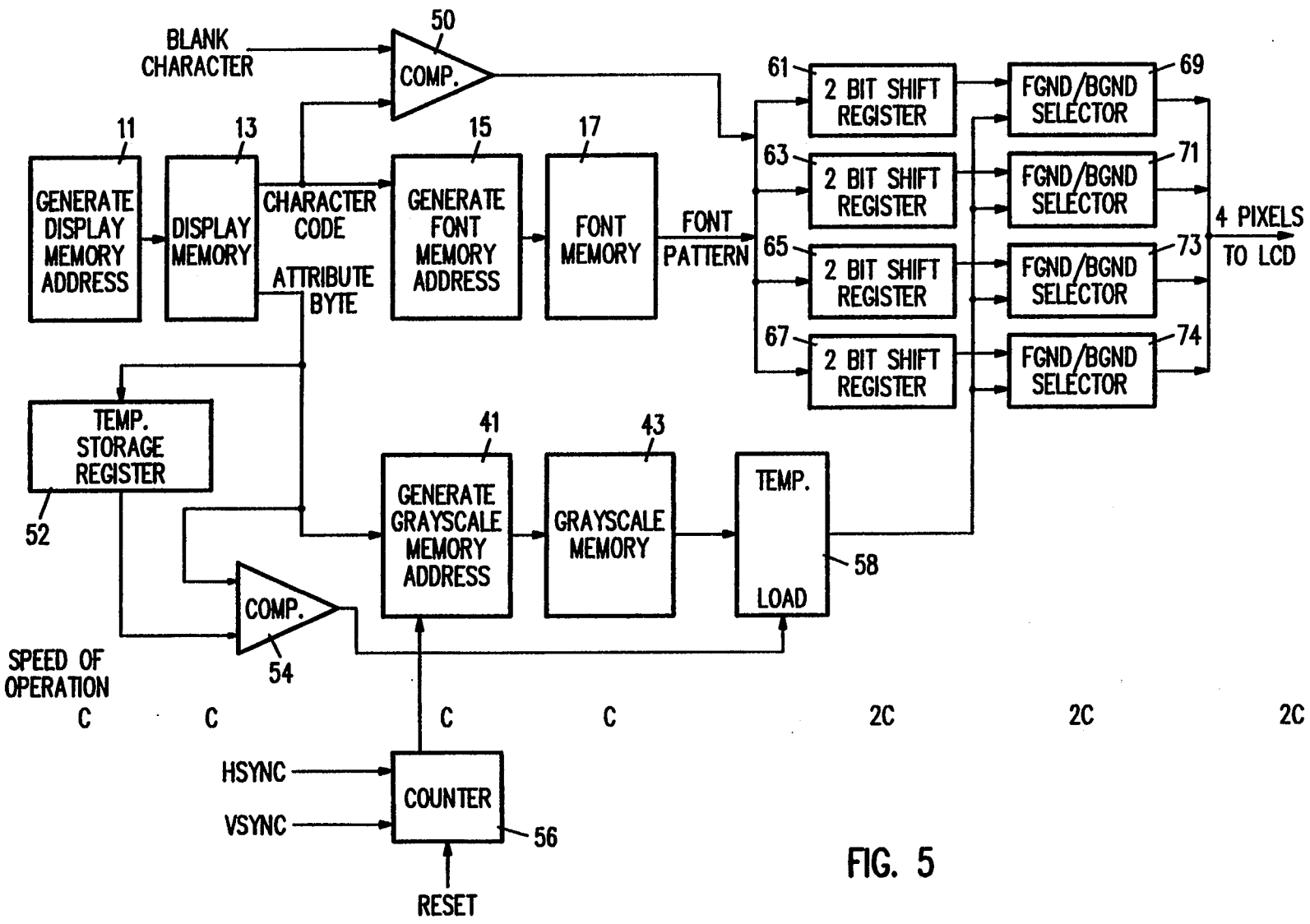
FIG. 5 is a second embodiment of the present invention.

In one embodiment of the present invention, the LCD is divided into regions, with a separate table being created for each pixel in the region. As each table needs only 2 bits for each attribute byte, 4 tables can be combined and stored in the same byte in memory. The 4 pixels to share the same table are chosen so as to be 4 adjacent pixels on the same display line. Thus, each modified attribute byte has all the information needed to generate a 4 pixel area for the LCD panel in each frame. This method is shown in FIG. 5, which is identical to that shown in FIG. 4, except after the font pattern is retrieved at step 17 and the gray scale byte is retrieved at step 43. Thereafter, the 8-bit font pattern is divided by 4 and the four 2-bit segments are sent to 2-bit shift registers at steps 61, 63, 65 and 67. The gray scale pattern is then also split into four 2-bit segments and combined with the font pattern bits at steps 69, 71, 73, and 75. Finally, the resultant pixel data is sent to the LCD. This implementation has the advantage of reducing the running speed of the apparatus by a factor of 4 (the apparatus needs "to run" only once to display 4 pixels), thereby reducing power consumption.

Many variations are possible to insure proper FRC operation. For example, if an 8 grayscale display is desired, an 8 frame FRC would be used with a different pattern for each pixel in a $4\times4$ pixel block. This implementation would require $4\times4\times8\times256/8 = 8k$ bytes. Alternatively, if a 16 grayscale display is desired, a 16 frame FRC would be used with a different pattern for each pixel in a $4\times2$ pixel block. The total memory requirement remains 8k bytes. In other implementations, the vertical phase might also-be carefully controlled.

It is to be understood that the above description is intended to be illustrative and not restrictive. Many variations of the invention will become apparent to those of skill in the art upon review of this disclosure. For example, gray scales of more than 16 levels could be generated, the area of the regions stored and manipulated in the tables could be increased, and the gray scales themselves could be modified as desired. Given these variations, the scope of the invention should, therefore, be determined not with reference to the above description, but instead should be determined with reference to the appended claims along with their full scope of equivalents.

What is claimed is:

1. A method for converting character signals having a character Code and an attribute code. The attribute code indicating a background and a foreground gray scale, the method comprising the steps of:

calculating a conversion table comprised of a plurality of entries, each entry in the table indicating the foreground and background gray scale for a given attribute code;

storing the conversion table in a memory;

retrieving an entry from the table for each character signal to be Converted, the attribute Code indicating which entry in the table is to be retrieved;

displaying the character using the foreground and background gray scale indicated by the entry retrieved;

storing, in a temporary storage register, the attribute code of the first character to be converted;

comparing the attribute code of succeeding character signals to the attribute code stored in the temporary register;

not accessing the conversion table if the succeeding character's attribute code is stored in the register; and accessing the conversion table using the attribute code of the succeeding character and replacing the character code stored in the register with the succeeding character's attribute code if the succeeding character's attribute code differs from the stored attribute code.

2. In a computer system having a monochrome display, the display displaying gray scale images by activating display elements a predefined number of times over a predefined number of frames, the maximum predefined number of times being the frame rate, a method for converting color character signals having a character code and an attribute code, the attribute code defining the foreground and background color of the character code, to gray scale character signals, the method comprising the steps of:

calculating, for each attribute code, a predefined number of frame entries, the predefined number of frame entries being equal to the frame rate, each entry defining whether the display element should be activated in the particular frame corresponding to the frame entry;

storing each frame entry in a separate frame table, the number of frame tables being equal to the frame rate, the frame tables being stored in memory;

receiving a first character signal;

retrieving a first frame entry from the first frame table corresponding to the attribute code of the first character code;

repeating the retrieving step once for each successive frame using the first attribute code, a counter counting the number of the frame, until the frame count equals the frame rate;

resetting the counter; and repeating the receiving, retrieving, repeating and resetting steps for each successive character signal.

3. The method of claim 2 wherein each frame entry indicates the display elements to be activated over a predefined area of the monochrome display.

4. The method of claim 3 wherein the display elements to be activated over a predefined area are varied randomly from frame entry to frame entry.

5. The method of claim 3 wherein the frame entry information for four adjacent display elements are stored in each frame entry, the retrieval of one frame entry thereby producing four of the display elements, thus reducing the rate of frame entry retrieval needed to produce the display.

6. A method for converting character signals having a character code and an attribute code, the attribute code indicating a background and a foreground color, into gray scale signals having a character code, a foreground gray scale and a background gray scale, the method comprising the steps of:

calculating a conversion table comprised of a plurality of entries, each entry in the table indicating the foreground and background gray scale for a given attribute code;

storing the conversion table in a memory;

comparing the character code of the character signal to the character code for a blank character;

retrieving an entry from the table for each character signal to be converted, the attribute code indicting which entry in the table is to be retrieved if the character code of the character signal is not the same as a blank signal; and displaying the character using the foreground and background gray scale indicated by the entry retrieved.

* * * * *